United States Patent [19]

Wolff

[11] Patent Number: 4,974,478

[45] Date of Patent: Dec. 4, 1990

[54] DEVICE FOR TIGHTENING THE SCREW ON SCISSORS

[76] Inventor: Lee S. Wolff, Rte. 5, Box 113, Spartanburg, S.C. 29301

[21] Appl. No.: 221,301

[22] Filed: Jul. 19, 1988

[51] Int. Cl.[5] ..... B25B 23/08

[52] U.S. Cl. ..... 81/456; 81/58.3

[58] Field of Search ..... 81/58, 58.3, 58.4, 60, 81/421–426, 451, 454, 456, 457

[56] References Cited

U.S. PATENT DOCUMENTS

| | | | |
|---|---|---|---|
| 1,191,873 | 7/1916 | Cressy et al. | 81/456 |
| 1,795,054 | 3/1931 | Summers | 81/456 |
| 1,802,666 | 4/1931 | Mueller | 81/456 |
| 2,005,723 | 6/1935 | Munn | 81/456 |
| 2,033,892 | 3/1936 | Parvin | 81/456 |
| 2,079,863 | 5/1937 | Koon | 81/456 |
| 2,352,917 | 7/1944 | Scott | 81/456 |

FOREIGN PATENT DOCUMENTS

| | | | |
|---|---|---|---|
| 500711 | 2/1951 | Belgium | 81/456 |

*Primary Examiner*—J. J. Hartman

*Attorney, Agent, or Firm*—Dority & Manning

[57] ABSTRACT

A screw driving and gripping tool for holding and tightening the screws on pivoted tools such as scissors shears and the like having a variety of thicknesses. The screw driver and gripping device includes a pair of elongated gripping members which are pivotably connected and each of which has a pair of jaws on one end. One of the jaws is adapted to support tools being tightened and the other of the jaws is adapted to support a screw driving bit for engaging the kerf of the screws on pivoting tools such as scissors, shears and the like. The screw driving bit is supported in a support which is drivingly connected to the screw driver jaw while rachet motion in either direction and for driving the screw driver bit whenever the tool grips a tool whose screw is to be tightened. The screw driving bit projects from the screw driver support jaw a variable distance so that shears scissors or the like of variable thicknesses can be accommodated with the screw driver bit still engaging squarely into the kerf of the screw holding the scissors or shears. Means are provided for adjusting the distance that the screw driver bit projects from the screw driver support means so that the device can accommodate shears of variable thicknesses.

18 Claims, 2 Drawing Sheets

DEVICE FOR TIGHTENING THE SCREW ON SCISSORS

BACKGROUND OF THE INVENTION

This invention relates to a screw driver for holding and tightening the screws on scissors, shears and other thin objects where great pressure must be exerted to tighten or to loosen the screw.

Whenever it is necessary to tighten or loosen the screw on scissors, shears or the like it is necessary to apply substantial pressure to the screw and it is very important that the screw driver blades engage the kerf or the driving slot on the screw squarely. Since the thickness of the scissors or shears vary, the point of the screw driver blade engages the screw also varies, and the screw driver blade will not squarely engage the driving slot in the screw unless the length of the screw driver blade is adjusted so that it will engage the driving slot in the screw when the two jaws are parallel.

In the past, attempts have been made to provide pressure gripping screw drivers for scissors. One example is found in U.S. Pat. No. 1,795,054. The device in this patent is a pliers-like device with two jaws for clamping the scissors and the screw. One of the jaws has, extending therethrough, a screw driver for engaging the driving slot in a screw on scissors or the like. However, this tool will only properly engage one thickness of shears or scissors. If a shears or scissors of different thickness is tightened or attempted to be tightened by the tool in this patent proper engagement of the screw driver bit 4 with the driving slot or kerf of the screw will not be made and as a result the driving slot in the screw may be mangled or ruined. This patent also provides a ratcheting drive for the screw driver.

Another pressure screw driver device is found in U.S. Pat. No. 2,352,917. The tool in this patent has two screw driving mechanisms. One is for very thin scissors and the other for enlarged heavy duty shears. However, this device is still limited to properly engaging only two sizes of shears or scissors and cannot be adjusted to properly engage the screws on a variety of thicknesses of shears or scissors.

Another tool is found in the combined pliers and screw driver of U.S. Pat. No. 2,079,863. The combined pliers and screw driver shown in this patent includes a rachet or spring-loaded engaging drive between the clamping jaws and the screw driver blade, for driving the screw driver in either direction. However, this device will only properly fit scissors of a predetermined thickness and a different tool must be used for scissors or shears having a greater or lesser thickness than what the tool is designed for.

Other tools for this purpose are shown in U.S. Pat. Nos. 1,191,873, 1,802,666, and 2,005,723, but none of these patents disclose or teach a tool which is adapted to fit shears or scissors of a multiplicity of thickness or sizes.

SUMMARY OF THE INVENTION

It is an object of the invention to provide a screw driver and gripping device for holding and tightening screws on pivoted tools, such as scissors, shears and the like.

It is another object of the invention to provide a combined screw driver and gripping device for holding and tightening screws on pivoted tools such as shears, scissors and the like of a variety of thicknesses and sizes.

It is yet another object of the invention to provide a combined screw driver and gripping device for holding and tightening screws of pivoted tools wherein the screw driver is rachet driven.

The objects set forth herein, and others which will become apparent hereinafter, are accomplished by the provision of a pliers-like tool with a pair of gripping jaws which are arranged parallel to each other whenever the handles are clamped together manually. One of the jaws has a surface for supporting the pivoted tool being tightened, whereas the other of the jaws has means for supporting a screw driver bit and the support has a ratchet drive connection with the jaw containing the support. Means are provided for adjusting the length that the screw driver bit protrudes from the surface of the screw driver support so as to fit parallel into the driving kerf or slot of the screw holding the pivoting tool together, firmly and securely without distorting or mangling the edges of the kerf or slot.

BRIEF DESCRIPTION OF THE DRAWINGS

The above and various other objects and advantages of the invention will be described and understood from the accompanying drawings, illustrating the invention, in which.

DETAILED DESCRIPTION OF THE DRAWINGS

Figure 1:
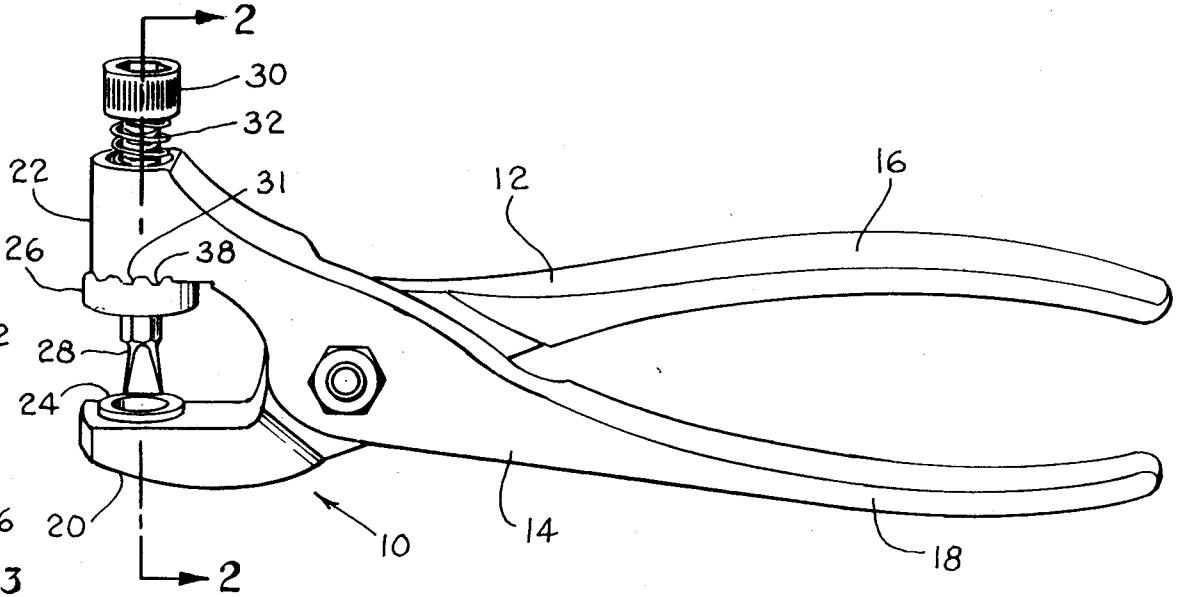
FIG. 1 ia a perspective view of the tool of the invention.

The illustrated embodiment of the invention comprises a combined screw driver and gripping tool 10 for tightening the screws of pivoted tools of varying thicknesses. Screw driver 10 includes an elongated member 12 which is pivotably connected to an elongated screw driver member 14. Member 12 has a handle 16 and support jaw 20 whereas screw driver member 14 has a handle 18 and a screw driver jaw 22. Support jaw 20 has a support anvil 24 disposed in a transverse bore 25 for supporting a tool whose screw is being tightened by the screw driver.

Figure 2:
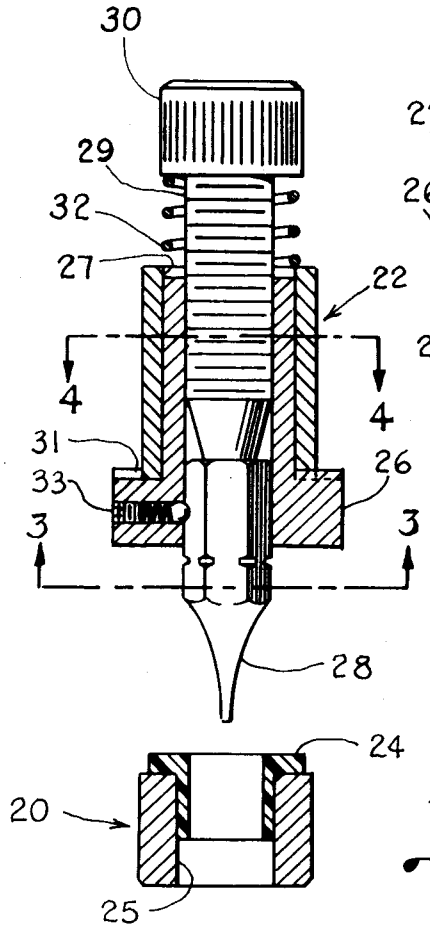
FIG. 2 is a sectional view of the tool taken along line 2—2 of FIG. 1.
Figure 4:
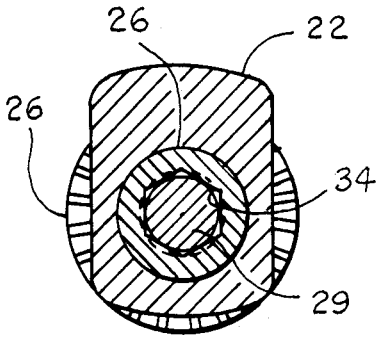
FIG. 4 is an enlarged sectional view of the jaw supporting the screw driver bit, taken along 4—4 of FIG. 2.

The screw driver jaw 22 comprises a ratchet drive 26, a portion of which is disposed within bore 27 of the screw driving jaw 22, as best seen in FIG. 2. The ratchet drive 26 is adapted to rotate within bore 27. Disposed within a hexagonal bore 34, is a screw driver bit 28 which is adapted to be driven by the ratchet drive 26. Also disposed within bore 34 is an adjusting screw 29 which is threaded into threads in bore 34, as best seen in FIG. 4, to hold ratchet drive 26 onto the surface of the screw driver jaw 22. The adjusting screw 29 has an adjusting screw head 30 which is knurled for ease of hand adjusting the depth that the adjusting screw 29 extends into hexagonal bore 34. This, in turn, adjusts the depth that screw driver bit 28 extends into bore 34, and, therefore, the extent that screw driver bit 28 projects from the surface of ratchet drive 26. Interposed between adjusting head 30 and the back surface of jaw 22 is a spring 32. Spring 32, when compressed by the head 30 of adjusting screw 29, urges the ratchet drive 26 into contact with the inner surface of the screw driver jaw 22 for a ratcheting connection between the drive grooves 31 on the inner side of ratchet 26 and drive grooves 38 on the inner surface of the screw driver jaw 22. The pressure of spring 32 is such as to permit slippage between grooves 36 and 38 when the handles are not pressed together. However, when jaws 20 and 22 are pressed together grooves 36 and 38 are pressed into firm driving relation. This relationship permits the ratchet drive to ratchet in either direction for driving purposes.

The ratchet drive 26 comprises a series of grooves 31 on the upper or inner surface of ratchet 26. Grooves 31 are held in mating contact with drive grooves 38 on driver jaw 22. Spring 32 urges the ratchet 26 into light contact with the driver jaw 22 but permits relative movement between the ratchet 26 and jaw 22 when the screw driver bit is under the light pressure exerted by spring 32 and is in contact with the kerf of the screw to be tightened. When handles 16 and 18 are squeezed together to firmly hold the kerf of the screw and the bit engaged, grooves 31 and 38 are clamped together in a driving relationship so that movement of the jaw 22 in either direction will also move or drive the ratchet 26.

However, when pressure on the screw driver bit is relieved, the driver jaw 22 may be moved relative to ratchet 26 in either direction. After the driver jaw 22 is repositioned for another stroke, pressure is again applied to urge the screw driver bit 28 into firm engagement with the kerf of the screw, and grooves 31 and 38 into driving engagement, to tighten or loosen the screw 48 as desired.

Figure 3:
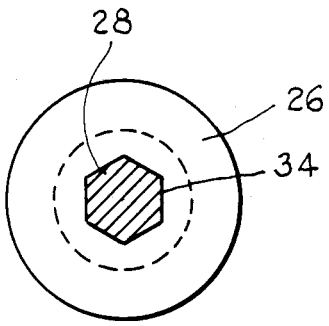
FIG. 3 is a sectional plan view of the screw driving jaw of the invention taken along line 3—3 of FIG. 2.

The screw driver bit 28 has a hexagonal cross-section at the point it enters hexagonal bore 34 so that the screw driver bit is rotated whenever ratchet 26 is rotated. As seen clearly in FIGS. 3 and 4, hexagonal bore 34 extends from one side of the ratchet drive 26 to the other, but it is threaded to receive adjusting screw 29. The extent to which screw driver bit 28 projects from the surface of ratchet drive 26 is determined by the position of adjusting screw 29. That is, the screw driver bit is pushed into the hexagonal bore 34 until it comes into contact with the end of adjusting screw 29.

It is to be understood that new driver bit 28 may be the blade type shown in the drawings or it may be of the phillips head type of kerf and blade. The bit 28 may be held within bore 34 by a spring-loaded detent 33, of common construction. However, the detent is not necessary where there is a close fit between bore 34 and bit 28.

Figure 5:
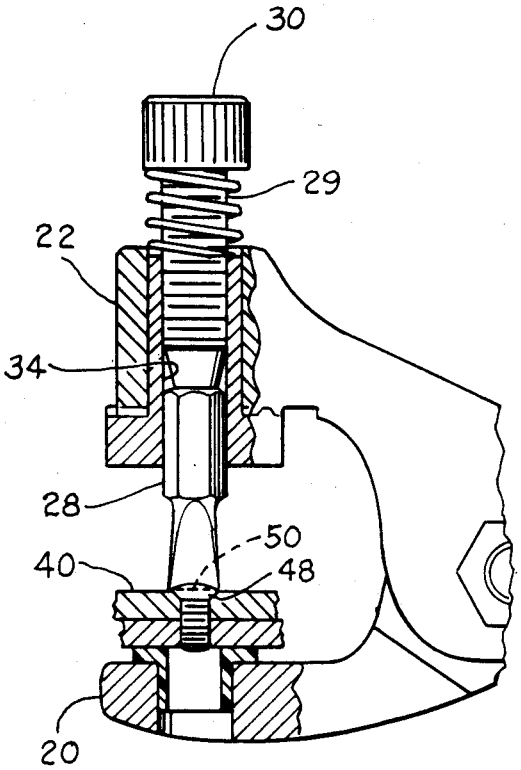
FIG. 5 is a side perspective view, partly in section of the screw driving and gripping jaws of the invention in use with a thin pair of scissors or tools.

Referring now to FIG. 5 of the drawings, wherein the screw driver of the invention is applied to a pivoted tool or scissors 40. The scissors 40 are held together in pivoting fashion by means of a machine screw or bolt 48 which extends through one of the pair of scissors members and is threaded into the opposite member of the scissors. Screw or bolt 48 has a kerf or driving slot 50. With jaws 20 and 22 arranged parallel to each other, the length of the screw driver bit 28 is adjusted by turning adjusting screw 29 to bring the blade of the screw driver bit 28 into parallel contact with the bottom of the drive slot or kerf 50, so that the screw driver can be firmly clamped evenly throughout the driving slot or kerf 50. When the depth of the screw driver bit is properly adjusted the screw driver and gripping device is ready to tighten the screw on the pivoted tool or scissors 40 at which time the handles of the members 12 and 14 are gripped to cause the drive grooves 31 and 38 to firmly engage each other to drive the screw driver bit 28 to then drive the screw 48 until the scissors are suitably tightened or loosened, as the case may be.

Figure 6:
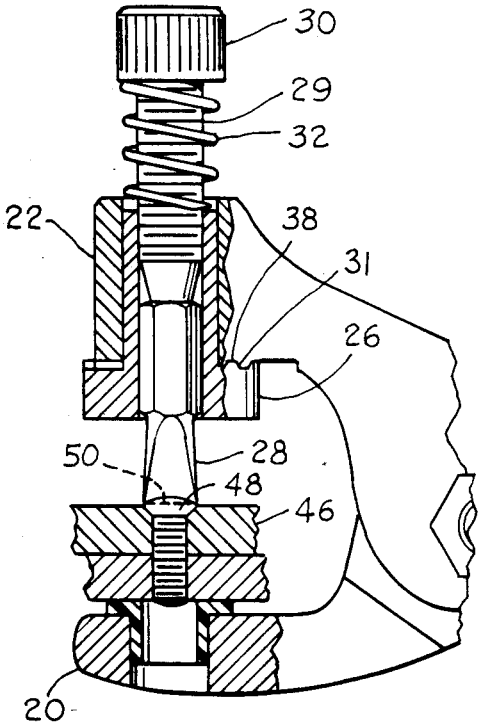
FIG. 6 is a view similar to FIG. 5 but showing the adjustment of the screw driver bit in use with a tool having greater thickness than that shown in FIG. 5.

Referring now to FIG. 6 the procedure is the same as that described above with regard to FIG. 5 except in this case a heavier set of pivoted shears is tightened with the same screw driver. In this case however, shears 46 are substantially thicker than the scissors 40 of FIG. 5. This requires that the screw driver bit 28 be shortened so that it may still engage the bottom of kerf 50 evenly.

In operation or usage, a pair of scissors or shears is placed on the supporting surface or anvil 24 of the support jaw 20 and the screw driver jaw 22 is moved to a position where it is substantially parallel to the anvil of jaw 20. After this position is attained the depth of the screw driver bit is adjusted so as to bring the bit squarely into parallel engagement with the bottom of the drive slot 50 before then squeezing the handles 16 and 18 to press the ratchet drive into driving connection with the screw driver support jaw 22. After the jaws are pressed together into a driving relationship the tool can then be used to loosen or tighten the screw of the pivoted tool.

It is to be understood that the above description is given only as an example of the structure of one embodiment of the invention and is not to be deemed as limiting the various features of the invention and the scope of its application or mode of operation. Various changes may be made in the particulars of the structure disclosed and in the mode of its operation without departing from the scope of the invention, the characterizing features of which are set forth in the following claims.

What is claimed is:

1. A screw driver and gripping device for tightening screws of pivoted tools of a variety of thicknesses, comprising:

(a) a pair of pivotally connected elongated members, one of which has a handle on one end and a support jaw having an anvil and a tool support surface on its other end and the other of said elongated members has a handle on one end adjacent to the handle on said one elongated member and its other end has a screw driver support jaw which opposes the tool support jaw on said one elongated member;

(b) a screw driver bit support having a driving bore with a non-circular cross-section for receiving and holding a screw driver bit, said screw driver bit support being supported on said screw driver support jaw for movement therewith in either direction when a pivoted tool is clamped between said tool support jaw and said screw driver support jaw, while permitting relative movement between said screw driver support jaw and said screw driver bit support when a pivoted tool is not clamped between said jaws;

(c) a screw driver bit releasably disposed within said driving bore and having a cross-section adapted to the cross-section of said driving bore, and projecting from said screw driver bit support towards said tool support jaw for engaging the kerf of screws in said pivoted tool; and (d) means for adjusting the distance said screw driver bit projects from said screw driver support jaw to accommodate pivoted tools of varying thicknesses with said screw driver bit squarely engaging the kerfs of the screws in tools of varying thicknesses.

2. A screw driver and gripping device as set forth in claim 1, wherein said screw driver bit has a portion having a hexagonal cross-section and said driving bore has a hexagonal cross-section for receiving said screw driver bit.

3. A screw driver and gripping device as set forth in claim 1, wherein said screw driver bit has a portion having a hexagonal cross-section and said driving bore has a hexagonal cross-section for receiving said screw driver bit.

4. A screw driver and gripping device as set forth in claim 1, wherein said screw driver bit support is urged into contact with said support jaw by resilient means.

5. A screw driver and gripping device as set forth in claim 4, wherein said resilient means comprises a coiled spring disposed about said means for adjusting the distance said screw driver bit projects from said screw driver support jaw.

6. A screw driver and gripping device as set forth in claim 1, wherein said screw driver bit support has a plurality of driving grooves which resiliently engage companion driving grooves on said screw driver support jaw for drivingly engaging said screw driver bit support to said screw driver support jaw when a tool is gripped by said device.

7. A screw driver and gripping device as set forth in claim 1, wherein said screw driver bit is resiliently held within said driving bore by a spring loaded detent.

8. A screw driver and gripping device as set forth in claim 1, wherein said screw driver bit support is drivingly connected to the screw driver support jaw by mating grooves on said screw driver support jaw and said screw driver bit support.

9. A screw driver and gripping device as set forth in claim 1, wherein said screw driver bit support is supported and held within a driving bore in said screw driver support jaw for rotation relative thereto when said jaws are not in a gripping relationship with each other.

10. A screw driver and gripping device as set forth in claim 9, wherein said means for adjusting the projection distance of said screw driver bit comprises and adjusting screw threaded within said driving bore of said screw driver bit support.

11. A screw driver and gripping device for holding and tightening screws holding pivoted tools of a variety of thicknesses, comprising:

(a) a pair of pivotally connected elongated members, one of which has a tool support jaw on one end and the other of which members has a screw driver support jaw on its end adjacent the tool support jaw of said one member;

(b) a screw driver bit;

(c) a screw driver bit support having a driving bore with a cross-section which corresponds to the cross-section of said screw driver for receiving and holding said bit, said screw driver bit support being supported on said screw driver support jaw for movement therewith when a pivoted tool is clamped between said jaws while permitting relative movement between said screw driver bit support and said screw driver support jaw when a pivoting tool is not clamped between said jaws; and (d) means independent of said screw driver bit for adjusting the distance said screw driver bit projects from said screw driver support jaw to accommodate pivoted tools of varying thicknesses with said screw driver bit squarely engaging the kerf of said screw in said tool.

12. A screw driver and gripping device as set forth in claim 11, wherein said means for adjusting the projection distance of said screw driver bit comprises an adjusting screw threaded within said driving bore of said screw driver bit support.

13. A screw driver and gripping device as set forth in claim 11, wherein said screw driver bit support is urged into contact with said support jaw by resilient means.

14. A screw driver and gripping device as set forth in claim 13, wherein said resilient means comprises a coiled spring disposed about said means for adjusting the distance said screw driver bit projects from said screw driver support jaw.

15. A screw driver and gripping device as set forth in claim 11, wherein said screw driver bit support has a plurality of driving grooves which resiliently engage companion driving grooves on said screw driver support jaw for drivingly engaging said screw driver bit support to said screw driver support jaw when a tool is gripped by said device.

16. A screw driver and gripping device as set forth in claim 11, wherein said screw driver bit is resiliently held within said driving bore by a spring loaded detent.

17. A screw driver and gripping device as set forth in claim 11, wherein said screw driver bit support is drivingly connected to said screw driver support jaw by a series of drive grooves on interfacing surfaces between said screw driver bit support and said screw driver support jaw for causing said screw driver bit support to move with said screw driver support jaw whenever said screw driver support jaw is urged towards said tool support jaw.

18. A screw driver and gripping device as set forth in claim 17, wherein said screw driver bit support may move relative to said screw driver bit support jaw in either direction when said jaws are not in a clamping relationship with each other.

* * * * *